US007103928B1

(12) United States Patent
Childs

(10) Patent No.: US 7,103,928 B1
(45) Date of Patent: Sep. 12, 2006

(54) PORTABLE AND ADJUSTABLE DUAL BED RAIL ASSEMBLY

(76) Inventor: Moty Childs, 10026 Caton Pl., Midwest City, OK (US) 73130

( * ) Notice: Subject to any disclaimer, the term of this patent is extended or adjusted under 35 U.S.C. 154(b) by 0 days.

(21) Appl. No.: 11/153,165

(22) Filed: Jun. 15, 2005

(51) Int. Cl.
*A47C 21/08* (2006.01)

(52) U.S. Cl. ..... 5/426; 5/429; 5/430

(58) Field of Classification Search ..... 5/425–430
See application file for complete search history.

(56) References Cited

U.S. PATENT DOCUMENTS 3,097,370 A * 7/1963 Murcott ..... 5/429
3,179,957 A * 4/1965 Norton ..... 5/428
3,289,223 A * 12/1966 Oja et al. ..... 5/428
3,823,428 A * 7/1974 Whyte ..... 5/429
3,855,654 A 12/1974 Pivacek
4,724,559 A 2/1988 Bly
4,747,171 A 5/1988 Einsele
5,038,430 A * 8/1991 Bly ..... 5/425
5,604,942 A 2/1997 Allevato
6,453,490 B1 9/2002 Cardinale
6,799,340 B1 10/2004 Schatz

* cited by examiner

*Primary Examiner*—Michael Trettel

(57) ABSTRACT

A bed rail assembly adapted to a bed having a box spring and a mattress, for securing both sides of a bed to prevent a bed occupant from rolling off either side, fits between the box spring and mattress and adjusts to any width mattress, having two side securing plates that maintain the assembly onto the sides of the mattress and box spring, the side securing plates attaching to side support rails within which vertically sliding bed rails are retained within a pair of rail locking mechanisms on each end of each side support rails, the vertically sliding bed rails being raised or lowered by releasing and locking open spring-loaded locking pins from mechanism housings within the rail locking mechanisms for each sliding bed rail to be raised or lowered.

9 Claims, 5 Drawing Sheets

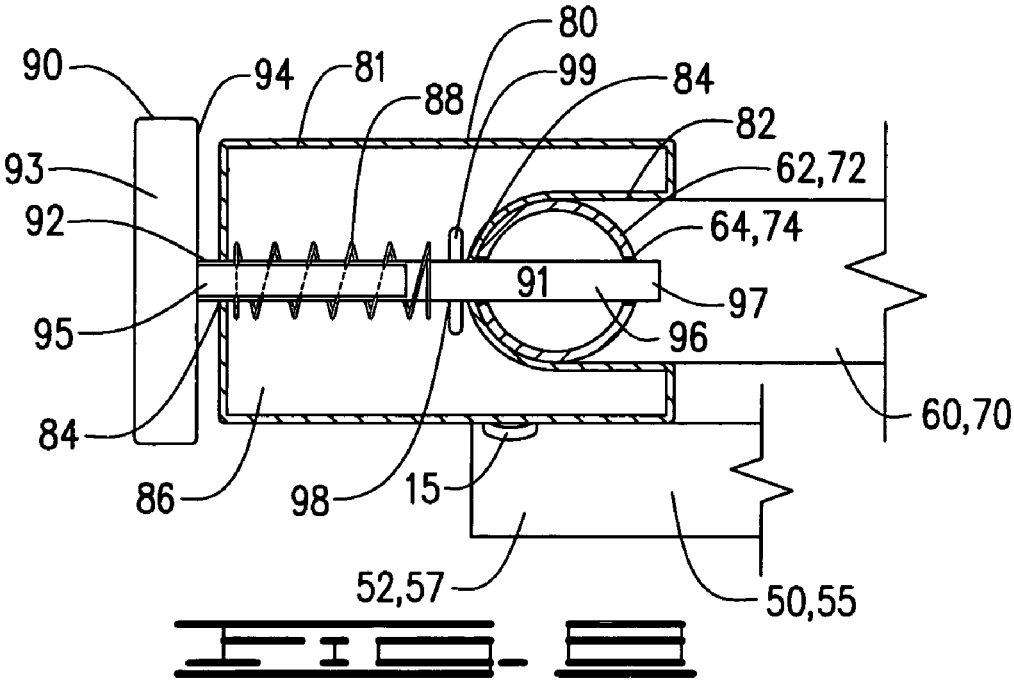
90
94
81
88
80
99
84
82
62,72
93
92
64,74
91
97
95
96
84
60,70
86
98
15
52,57
50,55
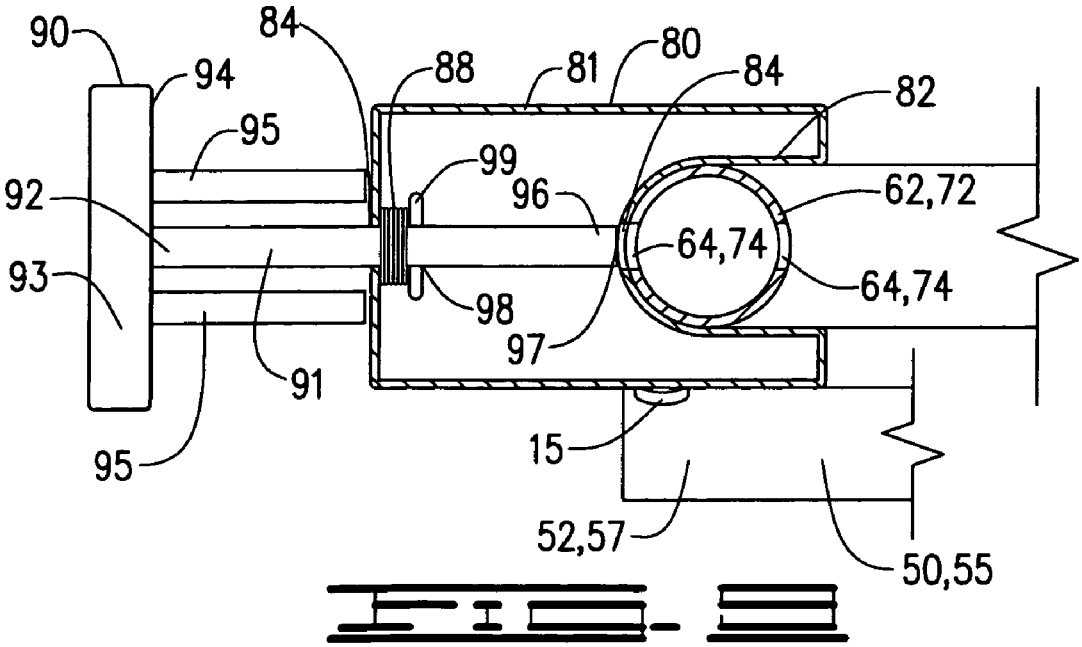
90
84
94
88
81
80
84
82
95
99
96
62,72
92
64,74
93
64,74
98
97
91
95
15
52,57
50,55

PORTABLE AND ADJUSTABLE DUAL BED RAIL ASSEMBLY

CROSS REFERENCE TO RELATED APPLICATIONS

None

I. BACKGROUND OF THE INVENTION

1. Field of Invention

A bed rail assembly adapted to a bed having a box spring and a mattress, for securing both sides of a bed to prevent a bed occupant from rolling off either side, fits between the box spring and mattress and adjusts to any width mattress, having two side securing plates that maintain the assembly onto the sides of the mattress and box spring, the side securing plates attaching to side support rails within which vertically sliding bed rails are retained within a pair of rail locking mechanisms on each end of each side support rails, the vertically sliding bed rails being raised or lowered by releasing and locking open spring-loaded locking pins from mechanism housings within the rail locking mechanisms for each sliding bed rail to be raised or lowered.

2. Description of Prior Art

The following United States patents were discovered and are disclosed within this application for utility patent. All relate to bed railing systems either adapted to a bed or made part of a bed frame.

The first three U.S. Pat. No. 5,604,942 to Allevato, U.S. Pat. No. 4,747,171 to Einsele and U.S. Pat. No. 3,855,654 to Pivacek, disclose bed rail supports that are pivotal on a vertical and horizontal plane, which attach to a bed frame. Their bed rails are raised by pivotal means and store in a horizontal plane below the surface of the bed, each device having a stop to retain a raised position and a spring or brake member to assist in the lowering of the bed rail to prevent rapid lowering of the bed rail.

U.S. Pat. No. 6,453,490 to Cardinale discloses a bed safety guard which has a frame that is inserted between a box spring and a mattress, making it portable. However, the bed rail is a fixed bed rail which cannot be lowered. The guard rail can be removed by disengaging it from the slat, which runs across the width of the bed, but does not suggest raising and lowering the guard rail.

In U.S. Pat. No. 4,724,559 to Bly, a telescoping bed side rail is adjustable for length and is connected to the bed frame. It features a spring-loaded quick release pin which allows for a quick attachment of the lower portion of the bed rail which is pivotally mounted to the bracket which is connected to the frame portion by a clamp assembly. It is intended for use on one side of the bed only, and its locking means attaches the bed rail to the pivotal bracket in only one position, which does not provide for the bed rail to be raised and lowered, only disengaged. It is also intended for a bed which raises, the telescoping portion of the bed rail becoming elongated when the bed is lowered, and retracted when the bed is raised.

Another bed rail mounting bracket attaching directly to the frame is found in U.S. Pat. No. 6,799,340 to Shatz, and it discloses a spring loaded locking pin with a manual gripping know fitted to a sleeve attached to a mounting bracket, the sleeve receiving a lower end of a bed rail, which is not claimed as part of the invention. It is unknown if the bed rail has multiple holes in it or not, since it is not claimed as part of the invention, these unknown holes receiving the end of the pin.

II. SUMMARY OF THE INVENTION

With small children or people who become incapacitated during illness, beds at home may require bed rails to retain a person in the bed during sleep or illness to prevent the person from falling off the bed. For those who do not have the ability to afford a hospital bed, or for those who simply wish to use a conventional bed, but need bed rails for a period of time. A temporary bed rail adapted to a bed having a box spring and mattress would provide this temporary protection without having to permanently attach the bed rail assembly to the bed. The assembly, being portable, would also allow a person to bring the bed rails with them during travel to apply the bed rail assembly to any bed, especially when the bed rail assembly would provide no permanent attachment and would be adjustable in width to provide the assembly adapting to any width of bed, especially when the component parts are collapsible and can be carried conveniently, with little set-up and no tools being required to assembly the device.

The primary objective of the invention is to provide a compact and portable bed rail assembly without requiring any attachment to a bed frame, the bed rail assembly being attached between a box spring and a mattress of any width bed. A secondary objective of the invention is to provide the component parts of the bed rail assembly to be transported in a compact manner without the requirement of any tools for assembly or disassembly. A third objective would be to provide the bed rail assembly with the bed rails being raised and lowered in a vertical direction to raise the bed rails to allow entry onto the bed surface, raising the bed rails once the person is in the bed, with a spring loaded pin retaining the bed rails securely in the raised or lowered position.

III. DESCRIPTION OF THE DRAWINGS

The following drawings are submitted with this utility patent application.

FIG. 8 is a top cross-sectional view of the locking mechanism with the spring loaded locking pin in the locked position, engaging one of a plurality of graduated locking holes in the lower end of the bed rail.

FIG. 9 is a top cross-sectional view of the locking mechanism with the spring loaded locking pin in the unlocked position, disengaged from the lower end of the bed rail.

IV. DESCRIPTION OF THE PREFERRED EMBODIMENT

Figure 1:
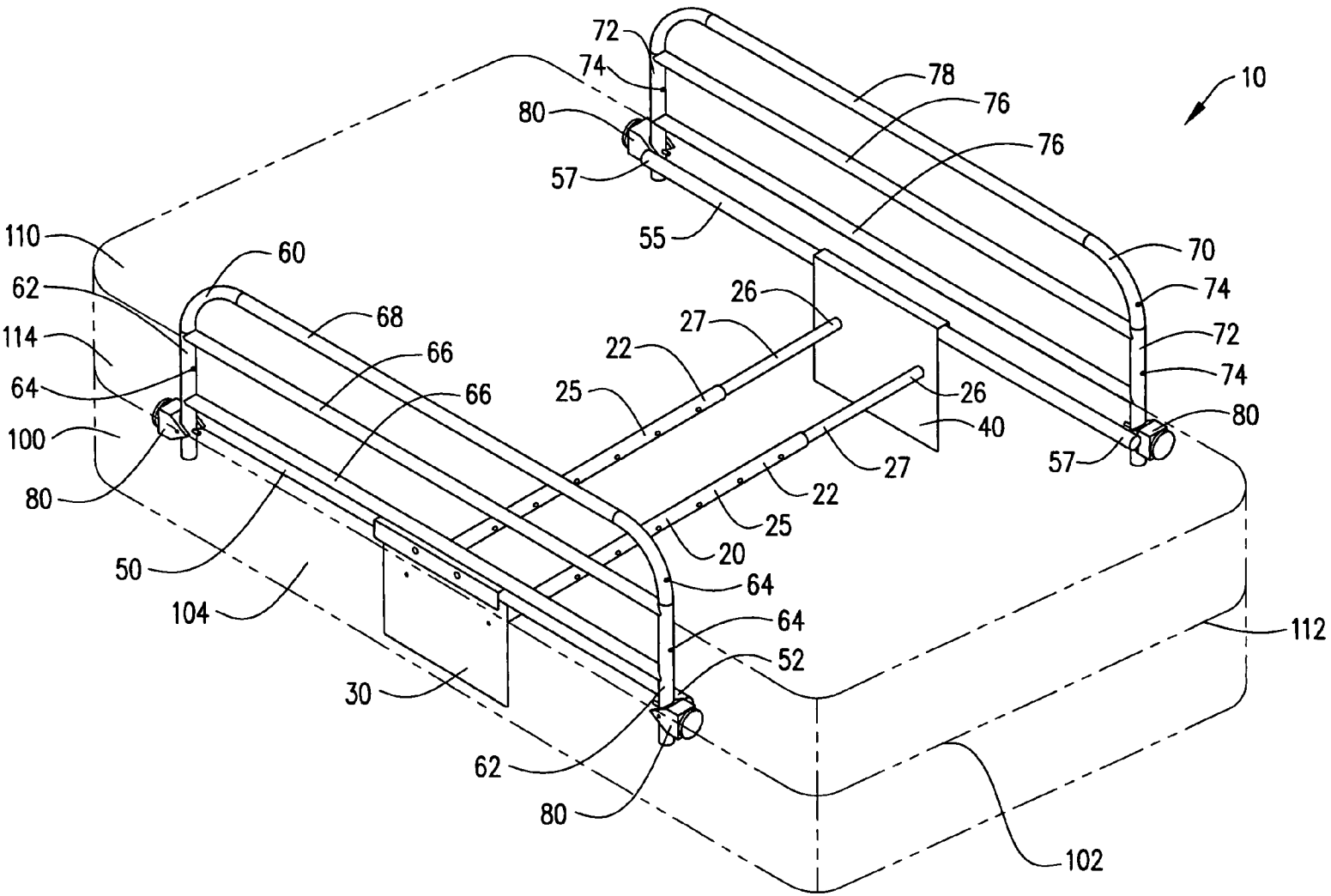
FIG. 1 is a perspective view of the bed rail assembly, with phantom lines indicating a box spring and mattress.

An adjustable bed rail assembly 10 shown in FIGS. 1–9 of the drawings, is adapted to a bed having a box spring 100 and a mattress 110 and comprises a telescoping base frame member 20 having at least two adjustable width cross-member supports 22, each having a first end 24 and a second end 26, the first ends 24 pivotally attached to a first end plate 30 and the second ends 26 pivotally attached to a second end plate 40, the first end plate 30 further removably attached to a first side rail member 50 and the second end plate 40 further removably attached to a second side rail member 55, the first side rail member 50 having respective ends 52 providing a pair of side rail locking mechanisms 80 and the second side rail member 55 having respective ends 57 providing a pair of side rail locking mechanisms 80, the pair of side rail locking mechanisms 80 on the first side rail member 50 slidably securing a first side rail component member 60 and the pair of side rail locking mechanisms 80 on the second side rail member 55 slidably securing a second side rail component member 70, each first and second side rail component 60, 70 independently raised and lowered in a vertical direction.

Figure 6:
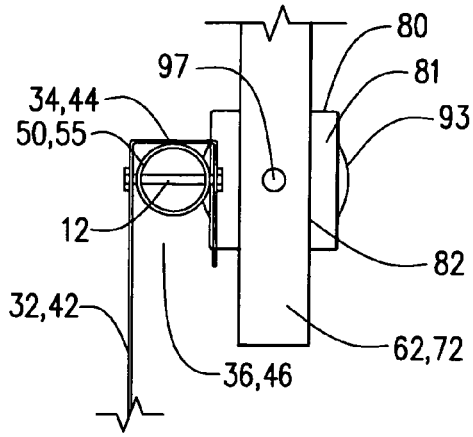
FIG. 6 is an inside and side view of the rail locking mechanism engaging the lower end of the bed rail.

The first end plate 30 is further defined as being an inverted J-shaped first end plate 32 having an upper crook portion 34 defining a side rail cavity 36 within which the first side rail member 50 is secured by at least two nuts and bolts 12, as indicated in FIG. 6. The second end plate 40 is also further defined as being an inverted J-shaped second end plate 42 having an upper crook portion 44 defining a side rail cavity 46 within which the second side rail member 55 is secured by at least two nuts and bolts 12, as indicated in FIG. 6.

Figure 2:
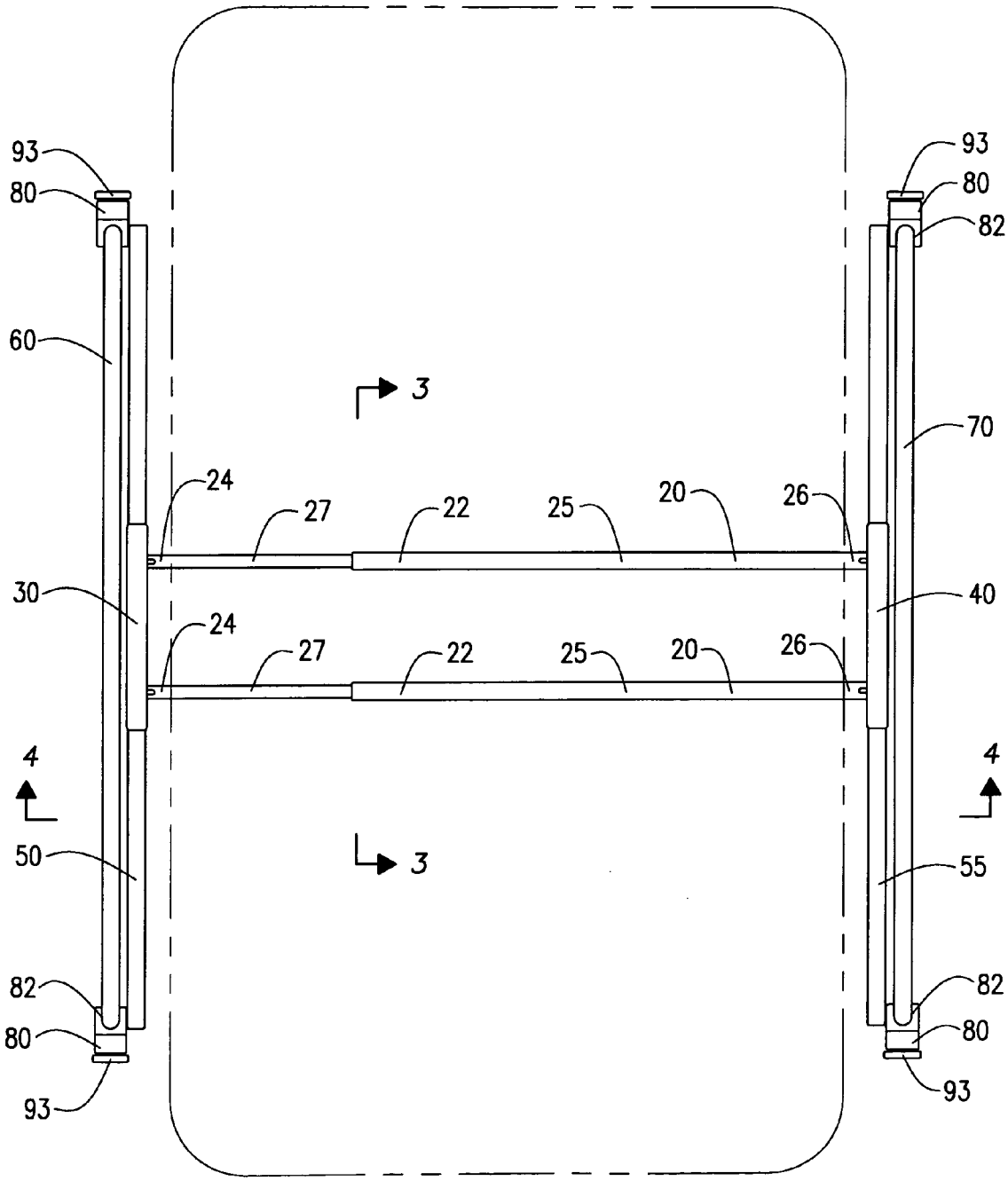
FIG. 2 is a top view of the bed rail assembly with phantom lines indicating a mattress.
Figure 3:
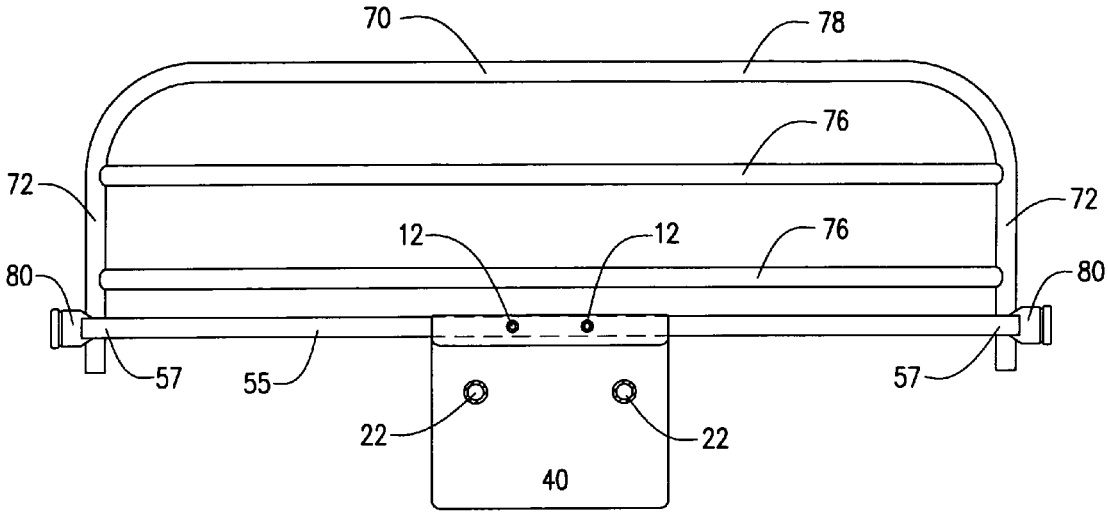
FIG. 3 is a cross sectional view of the assembly along reference lines 3/3 of FIG. 2.
Figure 4:
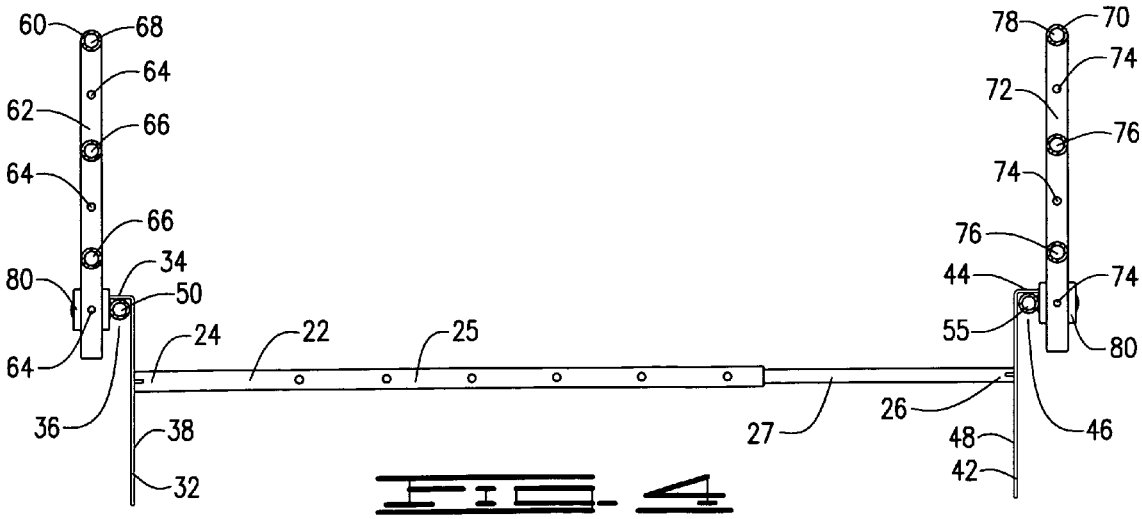
FIG. 4 is a cross sectional view of the assembly along reference lines 4/4 of FIG. 2.

The two adjustable width cross-member supports 22 further comprise a first telescoping section 25 which is slidably engaged within a second telescoping section 27, FIGS. 1, 2 and 4, and are secured to each respective first and second end plate 30, 40 placing the adjustable cross-member supports 22 in parallel, FIGS. 1–4, and in the same horizontal plane, FIGS. 1–4, wherein the cross member supports 22 lay flat between the upper surface 102 of a box spring 100 and the lower surface 112 of a mattress 110, FIG. 1, adjustable to the width of any bed from a full size to a king size mattress 110. The first and second end plates 30, 40 have an inner surface 38, 48 to which the adjustable cross-member supports 22 are pivotally attached and which abut the sides 104, 114 of the box spring 100 and mattress 110, as shown in FIG. 1.

Figure 7:
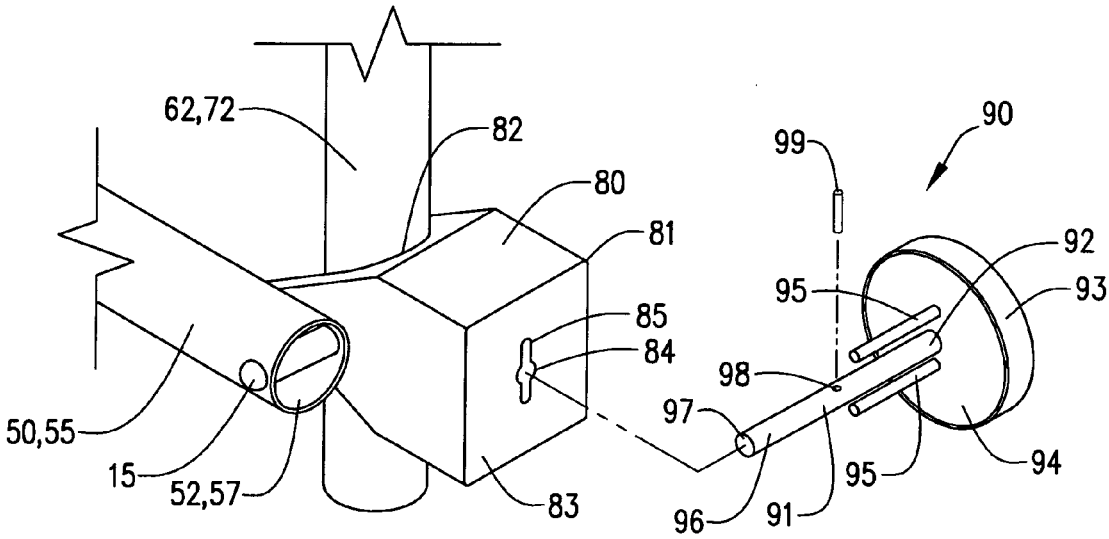
FIG. 7 is an outside perspective view of the rail locking mechanism with the spring-loaded locking pin removed from the mechanism housing.

Each side rail locking mechanism 80 is preferably provided as shown in FIGS. 5 and 7–9, further comprising a housing member 81 having an inner vertical concave rail receiver channel 82, an outer flat surface 83 having a lateral bore 84 from the outer surface 83 to the rail receiver channel 82, the lateral bore 84 having upper and lower keyed slots 85, the housing member 81 having a hollow inner cavity 86, a retractable locking pin 90, FIG. 7, having a shaft 91, a first end 92 defining a pull knob 93 and a second end 96 defining a rail engaging pin head 97, the locking pin 90 further including a transverse bore 98 with a spring retaining cotter pin 99, the retractable locking pin 90 inserted within the lateral bore 84, and a spring 88 placed upon the shaft 91 of the locking pin 90 between the cotter pin 99 and the first end 92 within the hollow inner cavity 86 of the housing member 81, the cotter pin 99 limiting the protrusion of the second end 96 into the rail receiver channel 82 and retaining the spring 88 upon the shaft 91, FIGS. 8–9. The pull knob 93 is further defined as having an inner surface 94 from which extend a pair of axial protrusions 95, FIG. 7, which, when aligned with the upper and lower keyed slots 85, allow the locking pin 90 to be drawn into the lateral bore 84 urging the second end 96 of the locking pin 90 into the rail receiver channel 82, FIG. 8. Rotating the pull knob 93 wherein the axial protrusions 95 are not aligned with the upper and lower keyed slots 85 maintains the pull knob 93 away from the outer flat surface 83 of the housing member 81 and withdraws the rail engaging pin head 97 of the locking pin 90 from the rail receiver channel 82, as shown in FIG. 9.

The attachment of each side rail locking mechanism 80 to each respective end 52, 57 of each respective first and second side rail members 50, 55 would be by a rivet 15, shown in FIGS. 7–9, with the rail receiver channels 82 facing each other, as shown in FIGS. 1–3, thereby containing the respective first and second side rail component members 60, 70 within the facing side rail locking mechanisms 80.

Figure 5:
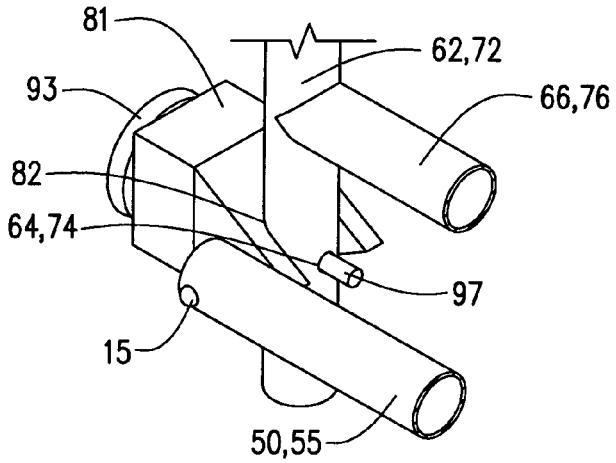
FIG. 5 is a perspective view of the rail locking mechanism.

The each first and second side rail component members 60, 70 would each further comprise two vertical rail portions 62, 72 between which are attached at least two horizontal support rails 66, 76 and an upper horizontal curved margin rail 68, 78, with each vertical rail portion 62, 72 having a plurality of transverse bores 64, 74 directed in the same direction as the horizontal support rails 66, 76, FIGS. 1 and 3. The two vertical rail portions 62, 72 of each first and second side rail component members 60, 72 are then inserted within the corresponding rail receiver channels 82 of the side rail locking mechanisms 80 and locked into position, FIGS. 5–8. In the preferred embodiment of the side rail locking mechanisms 80, this insertion would be accomplished by pulling the pull knobs 93 of the retractable locking pins 90 away from the outer flat surfaces 83 of the housing members, withdrawing the rail engaging pin heads 97 from the rail receiver channels 82 and turning the pull knobs 93 so that the axial protrusions 95 are not aligned with the upper and lower keyed slots 85, FIG. 9, inserting the vertical rail portions 62, 72 into the facing rail receiver channels 82, and sliding the side rail component member 60, 70 downward. The pull knobs 93 are then turned to align the axial protrusions 95 with the upper and lower keyed slots 85, releasing the retractable locking pins 90 and urging the rail engaging pin heads 97 towards the vertical rail portions 62, 72 and lowering or raising the first or second side rail component members 60, 70 until the selected transverse bores 64, 74 are positioned to allow the rail engaging pin head 97 to penetrate the selected transverse bores 64, 74, as shown in FIGS. 5 and 8 of the drawings.

The assembly 10 may be assembled by laying the two adjustable width cross-member supports 22 on the upper surface 102 of the box spring 100 and unfolding the first and second end plates 30, 40, sliding the first telescoping portion 25 and the second telescoping portion 27 of the cross-member supports 22 together until the first and second side plates 30, 40 are snug against the sides 104 of the box spring 100 and laying the mattress 110 on the upper surface 102 of the box spring 100 and the cross-member supports 22. The first side rail member 50 is attached to the first side plate 30 and the second side rail member 55 is attached to the second side plate 40. The first side rail component member 60 is then inserted within the side rail locking mechanisms 80 of the first side rail member 50 and the second side rail component member 70 is inserted within the side rail locking mechanisms 80 of the second side rail member 55. Each first and second side rail component member 60, 70 is then adjusted to the preferred height to prevent a person sleeping on the mattress from falling off the mattress. Disassembly would simply be to reverse the assembly process and transport the assembly to any bed for reassembly. When disassembled, the first and second end plates 30, 40 are folded against the adjustable cross-member supports 22, which are compressed to their smallest width, and the first and second side rail component members 60, 70 are laid together. For convenience, a bag may also be provided to store and transport the assembly, the bag not shown in the drawings.

In addition to the assembly as disclosed, it is contemplated within the scope of the invention that a cover may be applied over the side rail component members which would provide padding of the side rail component members, although not shown in any of the drawings. Other mechanisms could also be included as side rail locking mechanisms provided they allow for vertical adjustment of the side rail component members and secure the side rail component members at a preferred height, allowing for vertical adjustment. Also, while the invention has been particularly shown and described with reference to a preferred embodiment thereof, it will be understood by those skilled in the art that changes in form and detail may be made therein without departing from the spirit and scope of the invention.

What is claimed is:

1. An adjustable bed rail assembly adapted to be attached to a bed having a box spring and a mattress comprising: a telescoping base frame member having at least two adjustable width cross-member supports having first and second ends, said first ends pivotally attached to a first end plate and said second ends pivotally attached to a second end plate;

a first side rail member removably attached to said first end plate and a second side rail member removably attached to said second end plate, said first side rail member having respective ends providing a pair of side rail locking mechanisms and said second side rail member having respective ends providing a pair of side rail locking mechanisms; and a first side rail component member slidably secured between said side rail locking mechanisms on said first side rail member and a second side rail component member slidably secured between said side rail locking mechanisms on said second side rail member, each said first side rail component member and second side rail component member independently raised and lowered in a vertical direction.

2. The assembly as disclosed in claim 1, wherein:

said first end plate is an inverted J-shaped first end plate further comprising an upper crook portion defining a side rail cavity within which said first side rail member is secured by at least two nuts and bolts; and said second end plate is an inverted J-shaped second end plate further comprising an upper crook portion defining a side rail cavity within which said second side rail member is secured by at least two nuts and bolts.

3. The assembly as disclosed in claim 1 wherein:

said two adjustable width cross-member supports further comprise a first telescoping section slidably engaged within a second telescoping section secured to each respective first and second end plate placing said adjustable cross-member supports in parallel alignment and in a common horizontal plane allowing said cross member supports to lay flat between an upper surface of said box spring and a lower surface of said mattress.

4. The assembly as disclosed in claim 1, said first and second side rail component members further comprising:

two vertical rail portions between which are attached at least two horizontal support rails and an upper horizontal curved margin rail, with each vertical rail portion having a plurality of transverse bores directed in the same direction as the horizontal support rails, each said vertical rail portions of each first and second side rail component member are then inserted corresponding rail receiver channels of said side rail locking mechanisms and locked into a fixed position.

5. The assembly as disclosed in claim 1, each said side rail locking mechanism further comprising:

a housing member having an inner vertical concave rail receiver channel, an outer flat surface having a lateral bore from said outer flat surface to said rail receiver channel, said lateral bore having upper and lower keyed slots, said housing member having a hollow inner cavity;

a retractable locking pin having a shaft, a first end defining a pull knob and a second end defining a rail engaging pin head, said locking pin further including a transverse bore with a spring retaining cotter pin, said retractable locking pin inserted within said lateral bore; and a spring placed upon said shaft of said locking pin between said cotter pin and said first end within said hollow inner cavity of said housing member, said cotter pin limiting the protrusion of said second end into said rail receiver channel and retaining said spring upon said shaft, said pull knob is further defined as having an inner surface with a pair of axial protrusions, which, when aligned with said upper and lower keyed slots, allow said locking pin to be drawn into said lateral bore urging said second end of said locking pin into said rail receiver channel, and when not aligned where said axial protrusions are not aligned with said upper and lower keyed slots maintains said pull knob away from said outer surface of said housing member and withdraws said second end of said locking pin from said rail receiver channel.

6. An adjustable bed rail assembly adapted to be attached to a bed having a box spring and a mattress comprising: a telescoping base frame member having at least two adjustable width cross-member supports having first and second ends, said first ends pivotally attached to a first end plate and said second ends pivotally attached to a second end plate;

a first side rail member removably attached to said first end plate and a second side rail member removably attached to said second end plate;

a pair of side rail locking mechanisms attached to respective ends of said first side rail member and a pair of side rail locking mechanisms attached to respective ends of said second side rail member, each said side rail locking mechanism further comprising;

a housing member having an inner vertical concave rail receiver channel, an outer flat surface having a lateral bore from said outer flat surface to said rail receiver channel, said lateral bore having upper and lower keyed slots, said housing member having a hollow inner cavity;

a retractable locking pin having a shaft, a first end defining a pull knob and a second end defining a rail engaging pin head, said locking pin further including a transverse bore with a spring retaining cotter pin, said retractable locking pin inserted within said lateral bore; and a spring placed upon said shaft of said locking pin between said cotter pin and said first end within said hollow inner cavity of said housing member, said cotter pin limiting the protrusion of said second end into said rail receiver channel and retaining said spring upon said shaft, said pull knob is further defined as having an inner surface with a pair of axial protrusions, which, when aligned with said upper and lower keyed slots, allow said locking pin to be drawn into said lateral bore urging said second end of said locking pin into said rail receiver channel, and when not aligned where said axial protrusions are not aligned with said upper and lower keyed slots maintains said pull knob away from said outer surface of said housing member and withdraws said second end of said locking pin from said rail receiver channel; and a first side rail component member slidably secured between said side rail locking mechanisms on said first side rail member and a second side rail component member slidably secured between said side rail locking mechanisms on said second side rail member, each said first side rail component member and second side rail component member independently raised and lowered in a vertical direction.

7. The assembly as disclosed in claim 6, each first and second side rail component members further comprising:

two vertical rail portions between which are attached at least two horizontal support rails and an upper horizontal curved margin rail, with each vertical rail portion having a plurality of transverse bores directed in the same direction as said horizontal support rails, said two vertical rail portions of each first and second side rail component members inserted within said corresponding rail receiver channels of said side rail locking mechanisms and locked into position, accomplished by pulling said pull knobs of said retractable locking pins away from said outer surfaces of said housing members, withdrawing said rail engaging pin heads from said rail receiver channels and turning said pull knobs so that said axial protrusions are not aligned with said upper and lower keyed slots, inserting said vertical rail portions into said rail receiver channels, and sliding said side rail component member downward, after which said pull knobs are turned to align said axial protrusions with said upper and lower keyed slots, releasing said retractable locking pins and urging said rail engaging pin heads towards said vertical rail portions and lowering or raising said side rail components until said selected transverse bores are positioned to allow said rail engaging pin head to penetrate and retain said selected transverse bores.

8. The assembly as disclosed in claim 6, wherein:

said first end plate is an inverted J-shaped first end plate further comprising an upper crook portion defining a side rail cavity within which said first side rail member is secured by at least two nuts and bolts; and said second end plate is an inverted J-shaped second end plate further comprising an upper crook portion defining a side rail cavity within which said second side rail member is secured by at least two nuts and bolts.

9. The assembly as disclosed in claim 6 wherein:

said two adjustable width cross-member supports further comprise a first telescoping section slidably engaged within a second telescoping section secured to each respective first and second end plate placing said adjustable cross-member supports in parallel alignment and in a common horizontal plane allowing said cross member supports to lay flat between an upper surface of said box spring and a lower surface of said mattress.

* * * * *